US005488840A

United States Patent [19]

Wiedenhöfer

[11] Patent Number: 5,488,840

[45] Date of Patent: Feb. 6, 1996

[54] LATCH NEEDLE FOR A TEXTILE MACHINE

[75] Inventor: Kurt Wiedenhöfer, Albstadt, Germany

[73] Assignees: Theodore Groz & Söhne; Ernst Beckert Nadelfabrik Commandit-Gesellschaft, both of Albstadt, Germany

[21] Appl. No.: 314,252

[22] Filed: Sep. 29, 1994

[30] Foreign Application Priority Data

Oct. 6, 1993 [DE] Germany ..... 43 34 051.2

[51] Int. Cl.[6] ..... D04B 35/04; B21G 1/04

[52] U.S. Cl. ..... 66/122; 66/121

[58] Field of Search ..... 66/121, 122

[56] References Cited

U.S. PATENT DOCUMENTS 3,934,109 1/1976 Shepard et al. .

FOREIGN PATENT DOCUMENTS 0232466 8/1987 European Pat. Off. .

1040974 10/1953 France .

616441 7/1935 Germany .

3546037 9/1986 Germany .

836297 6/1960 United Kingdom .

*Primary Examiner*—John J. Calvert

*Attorney, Agent, or Firm*—Spencer & Frank

[57] ABSTRACT

A latch needle for a textile machine includes a needle shank having a sawslot defined in the needle shank by two facing cheeks forming part of the needle shank; a pivot pin supported by the cheeks and extending transversely to the length dimension of the needle shank; and a latch accommodated in the sawslot. The latch includes a latch shank having an upper side and an opposite lower side. There is further provided a bearing bore in the latch shank. The bearing bore is traversed by the pivot pin to provide for a pivotal movement of the latch relative to the needle shank. The bearing bore is spaced from the upper side at a first distance and from the lower side at a second distance; the first and second distances have unlike lengths.

5 Claims, 2 Drawing Sheets

LATCH NEEDLE FOR A TEXTILE MACHINE

CROSS REFERENCE TO RELATED APPLICATION

This application claims the priority of German Application No. P 43 34 051.2 filed Oct. 6, 1993, which is incorporated herein by reference.

BACKGROUND OF THE INVENTION

This invention relates to a latch needle for a textile machine. The latch needle has a needle latch which is accommodated in a sawslot of the needle shank and which is pivotally supported by a pivot pin passing through a bearing bore provided in the latch shank.

Latch needles of the above-outlined type are used in a number of textile machines, preponderantly in knitting machines but they may also find application, for example, in special sewing machines. The bearing for the latch has to comply with strict requirements as concerns mechanical stresses as well as the accuracy of the latch guidance. The latch is particularly highly stressed (loaded) if in rapid knitting machines soiled natural fiber yarns, for example, open-end yarns or elastomers are to be processed.

The latch bearing may be structured in different ways. Thus, from European Patent 0 232 466 it is known to have the latch supported by a pin passing through the bearing bore of the latch. The pin is supported in bores provided in the needle shank cheeks that define the sawslot. In the bores fixing elements are positioned that serve as axial abutments for the pivot pin.

Further, latch needles are known wherein the latch is pivotally supported on two bearing pins pressed out of the material of the needle shank cheeks. Such an arrangement is disclosed in U.S. Pat. No. 3,934,109 and U.K. Patent No. 836,297.

Further, German Offenlegungsschrift (application published without examination) 35 46 037 discloses an arrangement where only one of the needle shank cheeks is provided with a bore into which a pivot pin is press-fitted. The pivot pin has a length of approximately two-thirds of the needle shank thickness and engages the opposite needle shank cheek.

All the above-outlined latch supports seek to avoid a premature breakage of the needle shank cheeks, while the latch itself is not given primary consideration. The bearing bore provided in the latch is disposed transversely "centrally" in the latch shank in such a manner that the distances between the edge of the bearing bore and the upper and lower sides of the latch shank are approximately the same. Stated differently: the spacing of the bearing bore from the upper side of the latch shank is the same as from the lower side of the latch shank.

These solutions do not address another problem involved with latch needles: because of frictional wear and particularly impact-caused wear upon hard collision of the latch with the needle shank as the latch assumes its rearward position, the resulting lever action may cause a breakage of the latch shank in the zone of the bearing bore, thus limiting the service life of the latch needle.

SUMMARY OF THE INVENTION

It is an object of the invention to provide an improved latch needle of the above-outlined type which has a greater service life than conventional latch needles as concerns the breaking strength of the latch shank.

This object and others to become apparent as the specification progresses, are accomplished by the invention, according to which, briefly stated, the bearing bore is arranged in the latch shank in such a manner that the distances between the edge of the bearing bore and the upper and lower side of the latch shank are different.

A thorough service life analysis of latch needles has shown that after an extended operation a unilateral wear of the bearing bore occurs to one side of the latch shank; that is, the bearing bore becomes "ovalized". As a result, the latch pin, in the region of the bearing bore, eventually breaks the bearing bore edge at one side. The unilateral wear normally occurs at that side which is oriented towards the upper side of the latch shank but, for example, in case of a large overhang of the latch spoon beyond the hook tip the bearing bore may enlarge towards the lower side of the latch shank.

It is to be understood that the invention may find application in all latch needles in which a unilateral wear of the bearing bore occurs for reasons other than those described above.

In comparison with a needle latch where the bearing bore is situated in the middle between the upper and lower side of the latch shank, according to the invention that region of the latch shank which is particularly exposed to wear is significantly wider so that there is obtained an increased wear resistance without adversely affecting the mobility of the needle latch.

It is an advantage of the arrangement according to the invention that the latch shank itself is not wider than in conventional needles so that the mass of the latch which should be maintained as small as possible, is not increased. It is a further advantage that for manufacturing the needles according to the invention, no new stamping tools are required since the contour of the needle cheeks remains unchanged.

According to a preferred embodiment of the invention, the spacing of the bearing bore from the lower side of the latch shank is one-half the spacing of the bearing bore from the upper side of the latch shank. In some instances, the ratio of these distances may be expediently 1:3.

DESCRIPTION OF THE PREFERRED EMBODIMENT

Figure 1:
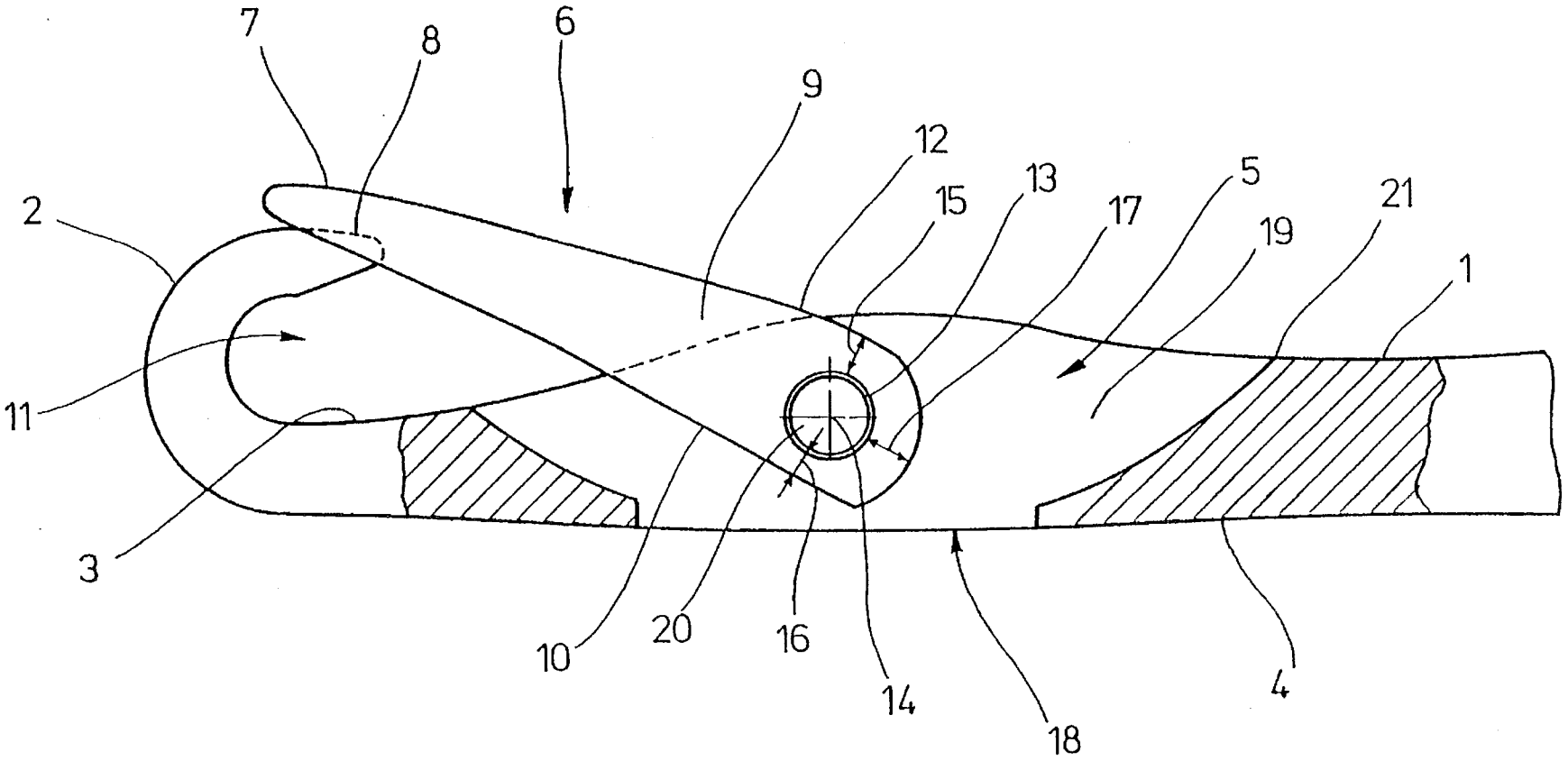
FIG. 1 is a sectional axial elevational view of the head part of a latch needle according to a preferred embodiment of the invention, shown with the latch closed.
Figure 2:
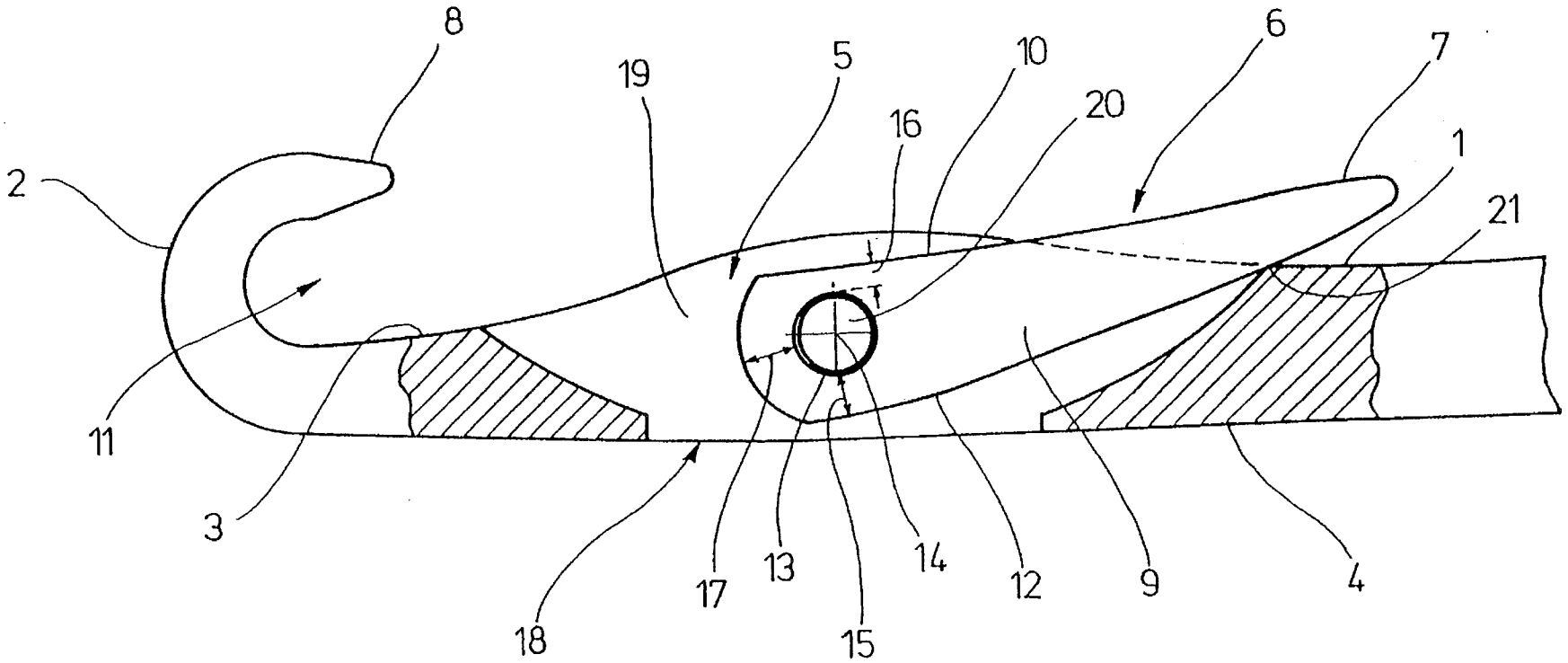
FIG. 2 is a sectional axial elevational view of the head part of a latch needle of FIG. 1, shown with the latch in the rearward open position.

The latch needle illustrated in FIGS. 1 and 2 has a needle shank 1 which at one end carries a hook (head) 2 and at its other, non-illustrated end may carry a butt or several butts and a follower member which cooperate in a known manner with cams of, for example, a knitting machine. In the needle shank 1 between the throat 3 and the shank groove 4, a sawslot 5 is machined symmetrically to the longitudinal axis of the needle shank 1 to accommodate a latch 6.

The needle latch 6 is of generally wedge-shaped configuration; the tip of the wedge forms a latch spoon 7 which, as shown in FIG. 1, lies on the hook tip 8 in the closed position of the latch 6. The latch spoon 7 is adjoined by a latch shank 9 whose underside 10, together with the hook 2, bounds the thread space 11 of the needle. The upper side 12 of the latch shank 9 is situated opposite its lower side 10. In that end region of the latch shank 9 which is remote from the latch spoon 7 a throughgoing cylindrical bearing bore 13 is provided whose axis is concentric with the pivot axis 14 of the latch 6. The bearing bore 13 is so arranged that the distances 15 and 16 to the upper side 12 and, respectively, the lower side 10 of the latch shank are different: the distance 15 between the edge of the bearing bore 13 and the upper side 12 of the latch shank is approximately twice the distance between the edge of the bearing bore 13 and the lower side 10 of the latch shank. As seen in FIG. 1, the lower side 10 is substantially linear, having an undeviating straight course, including those portions which pass by the bearing bore 13. As also seen in FIG. 1, the distance 15 is measured from a location of the upper side 12 which is closer to the bearing bore 13 than any other locations of the upper side 12 and the distance 16 is measured from a location of the linear lower side 10 which is closer to the bearing 13 than any other locations of the linear lower side 10. Dependent upon the construction of the latch needle and its latch, the ratio between the two distances 15 and 16 may be selected to be different. For many practical applications it has been shown to be expedient to select the (shorter) distance 16 between the bearing bore and the lower side 10 of the latch shank to be approximately one-third of the distance 15 between the bearing bore and the upper side of the latch shank.

The distance 17 of the edge of the bearing bore 13 to the end of the latch 6 which is opposite the latch spoon 7, is approximately the same as the distance 15 (which is the larger of the distances 15 and 16) between the edge of the bearing bore 13 and the upper side 12 of the latch shank. All distances 15, 16 and 17 are measured approximately radially from the edge of the bearing bore 13 in such a manner that at all times the smallest value is obtained; in differently structured latch shanks deviations from this rule are permissible.

The sawslot 5 is downwardly open at the underside of the needle shank to form a needle back punch 18 through which lint is discharged. The sawslot 5 is laterally, that is, transversely to the longitudinal axis of symmetry of the needle shank 1, bounded by the facing needle shank cheeks 19. In the sawslot 5 the latch 6 is supported for pivotal motion with play about a pivot pin 20 which extends with a clearance through the bearing bore 13 and which is supported in bores provided in the needle shank cheeks 19.

FIG. 1 shows the needle latch 6 in its closed position in which the latch spoon 7 lies on the hook tip 8.

In FIG. 2, the needle latch 6 is shown in its rearward position in which the latch 6 lies on the underside of the sawslot 5 at a region 21 of the needle shank 1.

During operation, the needle latch 6 arrives into its rearward position with a hard impact against the region 21 of the needle shank 1. This generates a lever action which leads to high stresses of the latch shank 9 in the zone between the bearing bore 13 and the upper side 12 of the latch shank. It is thus a purpose of the invention to provide a measure which seeks to neutralize the bearing bore wear caused by such high stresses.

In certain situations, the increased wear of the latch shank 9 occurs between the bearing bore 13 and the lower side 10 of the latch shank which may be the case, for example, when the latch has a significant overhang. In such cases the bearing bore 13 is so arranged that the distance 16 between the edge of the bearing bore 13 and the lower side 10 of the latch shank is greater than the distance 15 between the edge of the bearing bore 13 and the upper side 12 of the latch shank. As concerns the ratio between the two distances 15 and 16, there will then apply, in a reverse manner, the same preferred values as in the earlier described embodiment, that is, the distance 16 to the distance 15 will preferably have a ratio between 2:1 and 3:1.

It will be understood that the above description of the present invention is susceptible to various modifications, changes and adaptations, and the same are intended to be comprehended within the meaning and range of equivalents of the appended claims.

What is claimed is:

1. A latch needle for a textile machine, comprising (a) a needle shank having a length dimension and a sawslot defined in the needle shank by two facing cheeks forming part of the needle shank; said sawslot extending in said length dimension;

(b) a pivot pin supported by said cheeks and extending transversely to said length dimension;

(c) a latch accommodated in said sawslot; said latch including a latch spoon and a latch shank having an upper side and an opposite lower side; said lower side being linear and having a substantially undeviating course throughout; and (d) a bearing bore provided in said latch shank at a latch end opposite said latch spoon; said bearing bore being traversed by said pivot pin to provide for a pivotal movement of said latch relative to said needle shank; said bearing bore being spaced from said upper side at a first distance, from said lower side at a second distance and from said latch end at a third distance; said first distance being measured from a first location of said upper side and said second distance being measured from a second location of said linear lower side; said first and second locations being closer to said bearing bore than any other locations of said upper side and said linear lower side, respectively; said first distance being different from said second distance and said third distance being approximately the same as the larger of said first and second distances.

2. The latch needle as defined in claim 1, wherein said first distance is greater than said second distance.

3. The latch needle as defined in claim 2, wherein said first distance is approximately two to three times greater than said second distance.

4. The latch needle as defined in claim 1, wherein said first distance is smaller than said second distance.

5. The latch needle as defined in claim 4, wherein said first distance is approximately one half to one third less than said second distance.

* * * * *